US006597797B1

(12) United States Patent
Betts

(10) Patent No.: US 6,597,797 B1
(45) **Date of Patent: *Jul. 22, 2003**

(54) SPHERICAL LOUDSPEAKER SYSTEM WITH ENHANCED PERFORMANCE

(75) Inventor: Robert W. Betts, Shelton, CT (US)

(73) Assignee: Sonic Systems, Inc., Stratford, CT (US)

( * ) Notice: Subject to any disclaimer, the term of this patent is extended or adjusted under 35 U.S.C. 154(b) by 319 days.

This patent is subject to a terminal disclaimer.

(21) Appl. No.: 09/597,035

(22) Filed: Jun. 20, 2000

Related U.S. Application Data

(60) Provisional application No. 60/140,568, filed on Jun. 23, 1999.

(51) Int. Cl.[7] ..... H04R 11/04
(52) U.S. Cl. ..... 381/366; 381/160; 181/155
(58) Field of Search ..... 381/160, 366, 381/182, 186, 345; 181/153, 155, 156, 198, 199, 192, 187, 175, 152, 144

(56) References Cited

U.S. PATENT DOCUMENTS 4,989,254 A * 1/1991 Amalaha ..... 381/182
5,268,538 A * 12/1993 Queen ..... 181/144
5,306,880 A * 4/1994 Coziar et al. ..... 181/149

* cited by examiner

*Primary Examiner*—Curtis Kuntz
*Assistant Examiner*—Brian Ensey
(74) *Attorney, Agent, or Firm*—Melvin I. Stoltz

(57) ABSTRACT

By providing a spherically shaped loudspeaker and/or closure containing one or more drivers or speaker motors, mounted in cooperative association with a uniquely constructed reflector, a loudspeaker system is achieved which controls and shapes the ultimate acoustical waveform produced thereby. The system of present invention controls and distributes the acoustical energy of the driver, while shaping the acoustical energy field in a true hemispherical pattern, within the system's power bandwidth. By employing the present invention, the point of summation of the hemispherical pattern is approximately eight times the diameter of the reflector, thereby achieving the desired hemispherical polar coverage patterns.

10 Claims, 4 Drawing Sheets

SPHERICAL LOUDSPEAKER SYSTEM WITH ENHANCED PERFORMANCE

RELATED APPLICATIONS

This application is related to U.S. Provisional Patent Application, Ser. No. 60/140,568, filed Jun. 23, 1999 for a Spherical Loudspeaker System with Enhanced Performance.

TECHNICAL FIELD

This invention relates to loudspeaker systems and, more particularly, to loudspeaker systems constructed for controllably shaping the acoustical energy field into a true hemispherical pattern.

BACKGROUND ART

Loudspeakers are widely used for providing projection of voice and music in a variety of areas and for numerous purposes. One area in which loudspeakers are particularly important and have had substantial difficulty in providing good results is in large public areas. In such locations, the use of conventional loudspeakers is common, but there are difficulties because of the directional nature of the speakers' sound projection. As a result, in order to assure maximum coverage, numerous or multiple speakers are employed with overlapping coverage areas which requires proper engineering and often considerable expense to attain the desired results.

In an attempt to reduce the necessity of having numerous loudspeaker components installed to provide the desired coverage, loudspeakers having a hemispherical coverage pattern have been developed. Although many of these prior art loudspeakers had been able to provide a projection of voice and music over a wider listening area, numerous problems have continued to exist in producing products which achieve a true full frequency hemispherical sound projection pattern from a single overhead sound source.

One of the principal problems which has plagued prior art spherical loudspeakers as well as conventional loudspeakers centers on the physical characteristics of acoustic wave patterns. In this regard, audio frequencies essentially occupy 11 octaves of the electromagnetic spectrum, with acoustical wave lengths varying across a ratio of more than 2000 to 1 (about 113 feet to about ½ in.). In most applications, a more reasonable and workable ratio is 1000 to 1 (about 56 feet to 0.68 inches). Regardless of which ratio is employed, it is apparent, due to their very nature, that these extremes of wavelength energy require the application and use of completely different areas and aspects of the laws of physics.

Another problem inherent in providing optimum projection of voice and music is the fact that lower frequencies of the audio spectrum produce spherical waves which tend to be fluid in nature and difficult to control in terms of shaping and directing. Furthermore, higher frequencies develop planar waves which exhibit directional characteristics and are, by their very nature, not easily dispersed or diffused into broad coverage patterns. Finally, midrange frequencies produce various combinations of these two extremes.

In attempting to overcome these prior art problems, while also providing maximum area coverage, spherical loudspeaker systems with shaped dishes or "reflectors" suffer from one or more shortcomings. One such common problem is a severe decrease of high frequency energy distribution at the wider points of coverage, typically beginning at about 45 degrees from the central axis. Another common problem is a significant increase in phase distortion from unwanted multiple reflections occurring between the sound source and the reflector, as well as a significant increase in intermodulation distortion due to the remodulation of one-wave by another of a different frequency. Finally, high intensity lobes of acoustic energy are often produced directly on axis with the reflector, expanding as wide as 20 to 30 degrees from the central axis.

SUMMARY OF THE INVENTION

By employing the present invention, all of the difficulties and drawbacks of prior art loudspeaker constructions are eliminated and a true hemispherical sound pattern producing loudspeaker system is achieved which controls and shapes the ultimate acoustical waveform produced thereby. In the present invention, a loudspeaker system is provided which incorporates a spherically shaped loudspeaker and/or closure containing one or more drivers or speaker motors. In addition, a uniquely constructed reflector is employed which is mounted in cooperative association with the spherical enclosure. In this way, the system of the present invention controls and distributes the acoustical energy of the driver, while shaping the acoustical energy field in a true hemispherical pattern, within the systems power bandwidth. By employing the present invention, the point of summation of the hemispherical pattern is approximately eight times the diameter of the reflector, thereby achieving the desired hemispherical polar coverage patterns.

In the preferred construction, the reflector of the present invention is designed to be rigidly and mechanically attached to the spherical cabinet forming the loudspeaker or, alternatively, built into the construction of the sphere during the fabrication or molding process as a homogeneous or integral component thereof. The center or apex of the reflector is intended to be physically close to and acoustically intimately coupled with the geometric center of the driver's diaphragm.

In addition, the reflector also incorporates uniquely designed and shaped vanes formed on the surface thereof which enhance the output from the reflector by distributing the high frequency energy out to the broader angles of the coverage pattern. In the preferred embodiment, the vanes are constructed as secondary reflector vanes and comprise an exponential cross-section that is continuously variable over their entire length. In the preferred construction, the axial profile of the vanes is also exponential.

By employing the present invention, a loudspeaker system is achieved which controls and defines the wave shape and coverage patterns of the various frequency bandwidths, utilizing the natural characteristics of the wave itself, with no forced or artificial control. Using the three basic elements of a loudspeaker system—(1) the driver, (2) the spherical enclosure, and (3) the reflector—in a unique integral design, a synergistic interaction of these components is achieved which produces true hemispherical coverage patterns across the entire rated power bandwidth of the loudspeaker. Furthermore, the incorporation of these secondary reflector vanes substantially enhances performance with wide angle dispersion of the high frequency band being realized.

The invention accordingly comprises an article of manufacture possessing the features, properties, and relation of elements which will be exemplified in the article hereinafter described, and the scope of the invention will be indicated in the claims.

THE DRAWINGS

For a fuller understanding of the nature and objects of the invention, reference should be had to the following detailed description taken in connection with the accompanying the drawings, in which.

Figure 2:
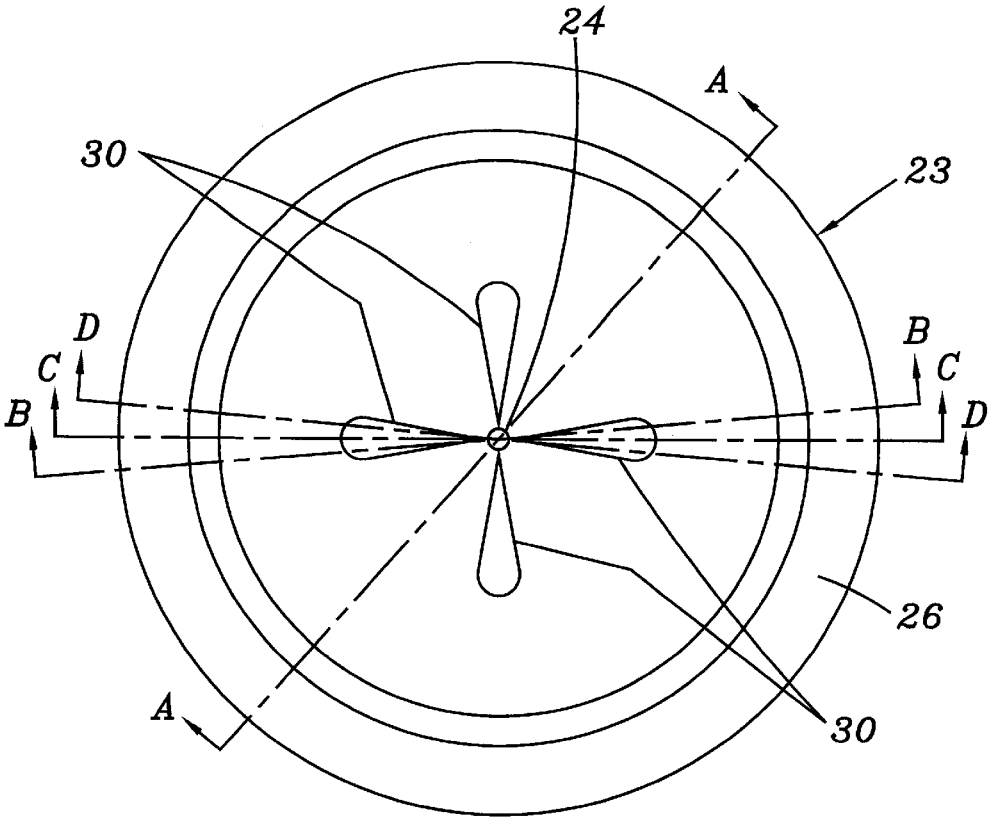
FIG. 2 is a bottom plan view of the reflector of the present invention incorporating the secondary reflector vanes.
Figure 3:
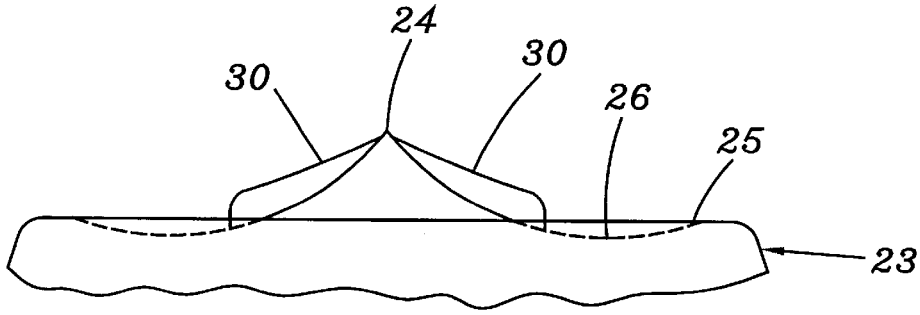
FIG. 3 is a side elevational view of the reflector of FIG. 2.
Figure 4A:
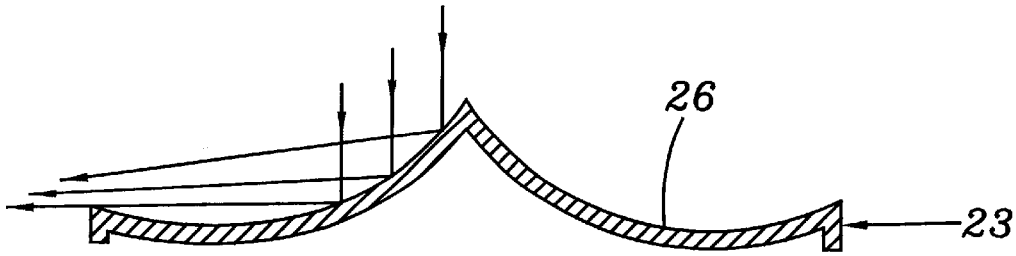
Figure 4B:
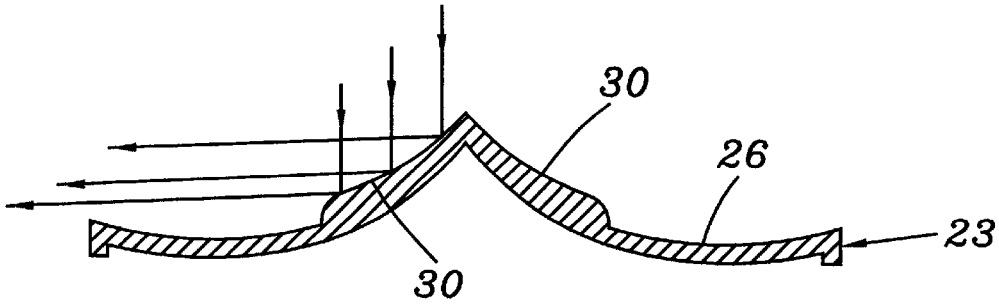
Figure 4C:
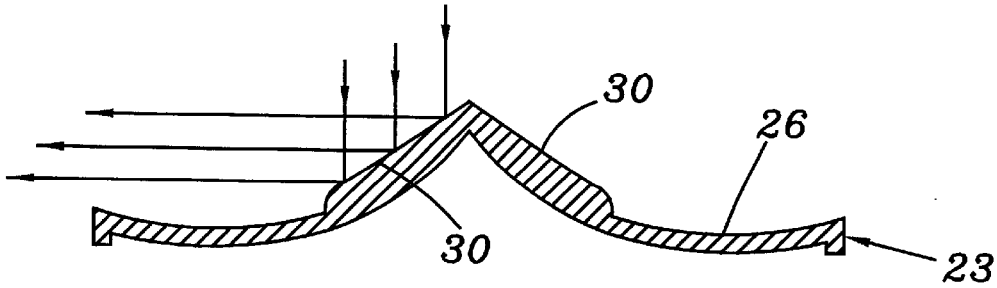
Figure 4D:
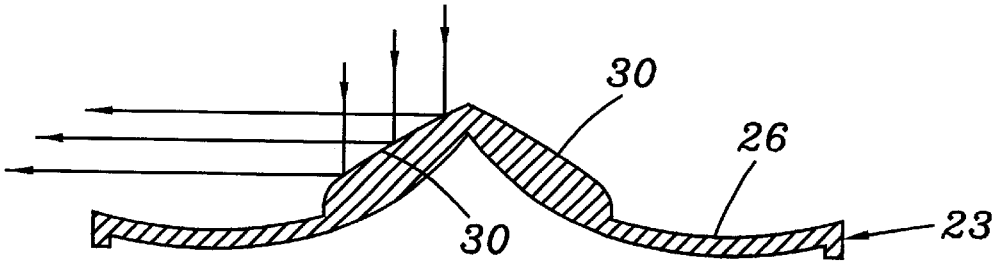
Figure 5:
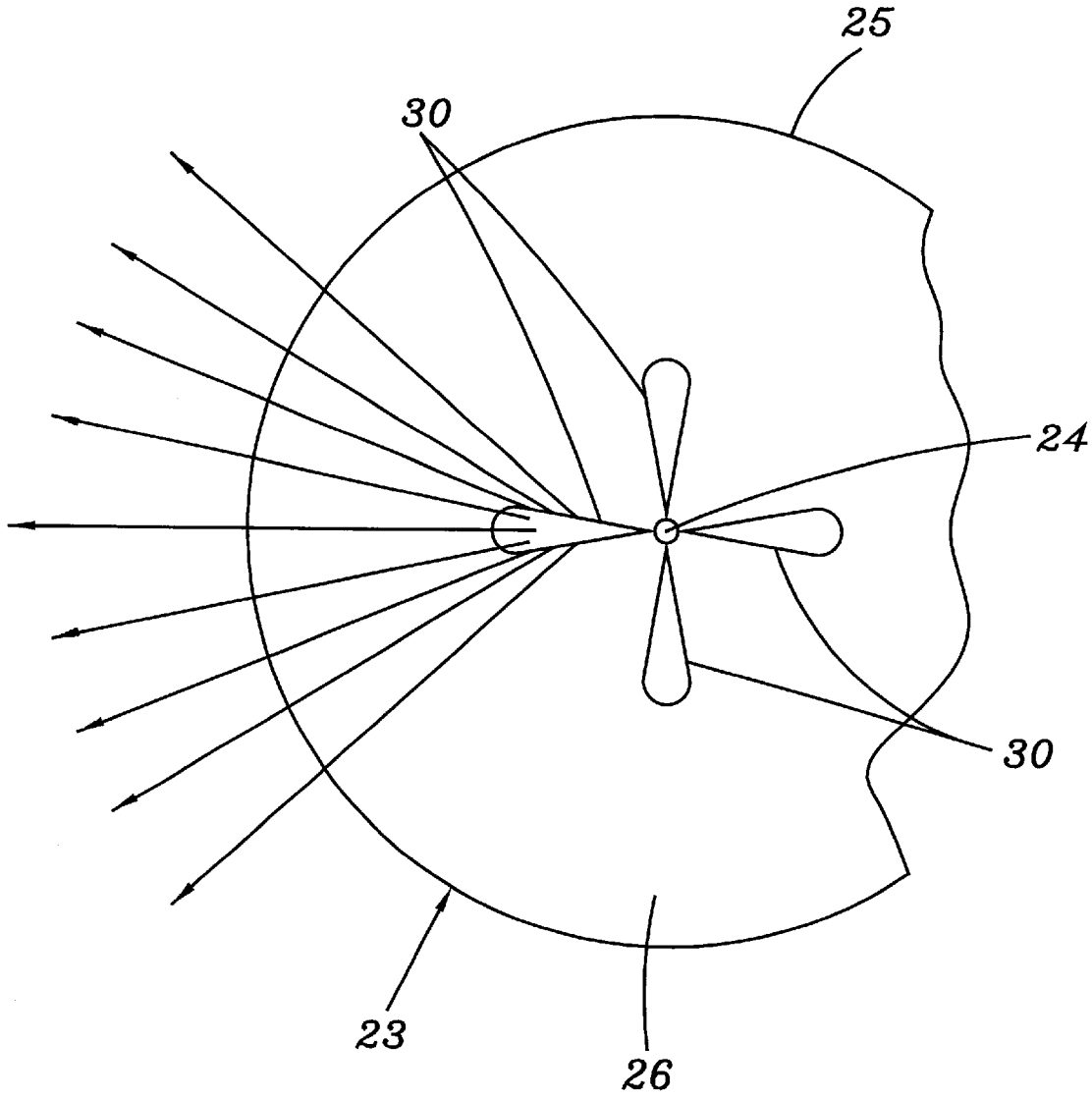

FIG. 4 comprises FIGS. 4A through 4D with each view being a cross-sectional side elevation view of the reflector and vanes of the present invention taken along different angles of the reflector;

FIG. 4A is a cross-sectional side elevation view taken along line A—A of FIG. 2, showing the cross-section between the vanes at the lowest angle;

FIG. 4B is a cross-sectional side elevation view taken along line B—B of FIG. 2, showing the cross-section along the sides of the vanes, with an increased angle;

FIG. 4C is a cross-sectional side elevation view taken along line C—C of FIG. 2, showing a cross-section halfway up the vanes at an angle approaching 90°;

FIG. 4D is a cross-sectional side elevation view taken along line D—D of FIG. 2, showing the cross-sectional at the top of the vanes depicting a full 90° angle; and FIG. 5 is a bottom plan view of the reflector and vane construction of this invention, depicting the ray pattern reflection achieved by the present invention.

DETAILED DESCRIPTION

By referring to FIGS. 1–5, along with the following detailed discussion, the overall construction and operation of the present invention can best be understood. As will become evident to one of ordinary skill in the art, FIGS. 1–5 depict the preferred embodiment of the present invention. However, alternate constructions and variations of this invention can be made without departing from the scope of this invention. Consequently, it is to be understood that the construction shown in FIGS. 1–5 is provided for exemplary purposes only and is not intended to limit the present invention thereto.

As is well-known in the industry, every speaker system's performance is affected by seven basic acoustical modes of operation. These seven modes are reflections, diffraction, refraction, diffusion, coupling, loading, and summation. In order to produce a true hemispherical wavefront from a single loudspeaker enclosure, each of these modes must be carefully balanced and applied to the designs. Since many of these modes are competing, each must be controlled and defined in their own unique characteristic way, as they apply to the wavelength of the frequency being transmitted. By integrating these acoustical modes as well as the inherent natural wavefront shape of various frequencies, the desired operation and preferred wavefront pattern can be created.

Figure 1:
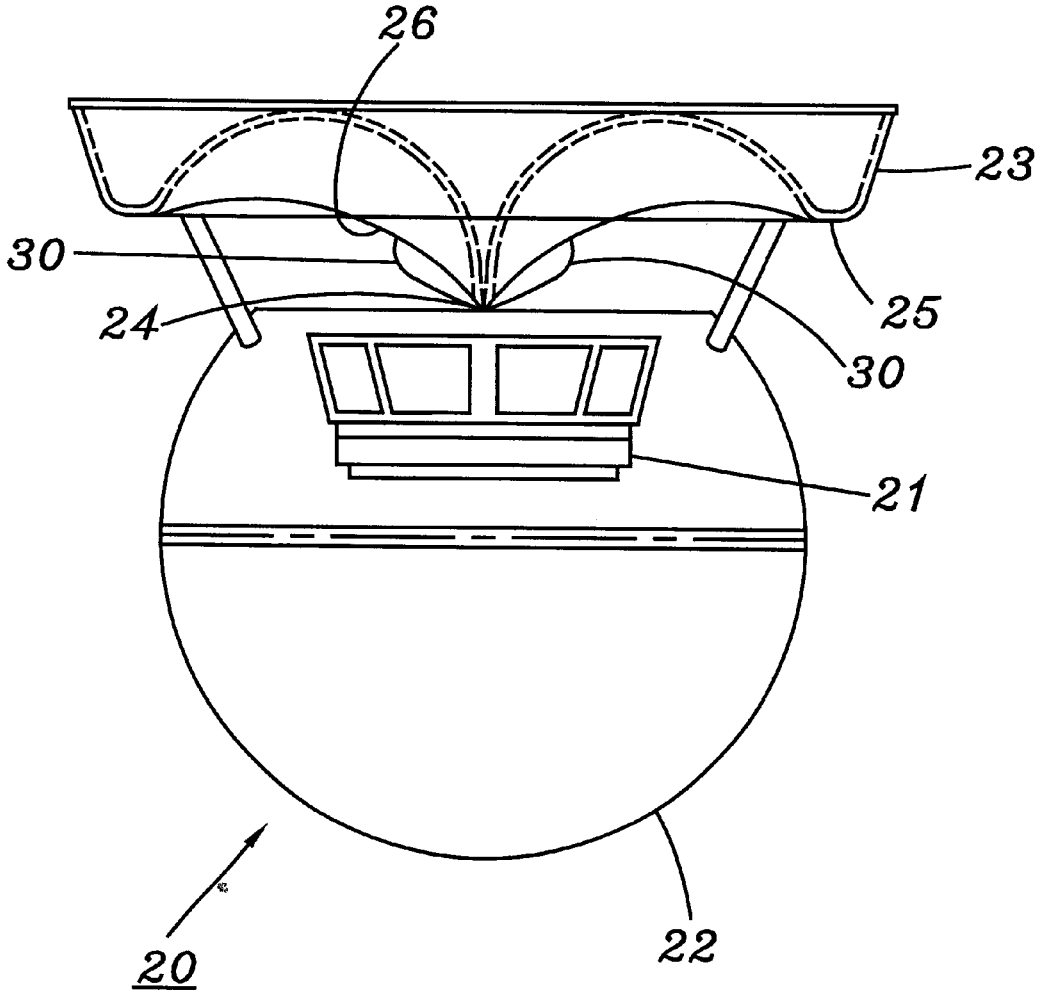
FIG. 1 is a side elevation view, partially in cross-section, depicting the spherical loudspeaker system and reflector enhancement of the present invention.

As shown in FIG. 1, loudspeaker system 20 of the present invention comprises at least one driver 21, spherical enclosure 22 and cooperatively associated reflector 23. In the present invention, driver 21 is designed for optimum sensitivity or efficiency, bandwidth or frequency response, linearity or flatness of response, transient response, lack of distortion or coloration, power handling and maximum sound pressure level capability. In order to function in the intended manner, all of these qualities must be present in speaker or driver 21, since spherical enclosure 22 and cooperating reflector 23 function as passive wave shaping and controlling devices, and cannot add to the purity, quality or fidelity of the acoustical signal generated by driver 21.

Spherical enclosure 22 and reflector 23 are constructed using generally well known forming technology in order to achieve the desired shape and the desired diameter. Typically, spherical enclosure 22 and/or reflector 23 may be formed from a wide variety of fabrication materials. Although any desired material may be employed, the preferred materials for fabricating spherical enclosure 22, and reflector 23 comprises one selected from the group consisting of fiberglass, plastics, structural foams, aluminum bonded to sound dampening materials, and steel bonded to sound dampening materials. In addition, although a wide variety of plastics made be effectively employed, the preferred plastics for forming these components are selected from the group consisting of acrylics, styrenes, polyvinyl chlorides and polycarbonates.

Reflector 23 is a principal component of the present invention in providing the desired hemispherical wavefront. As shown in FIGS. 1–5, reflector 23 comprises a radial concave shaped surface 26 extending from apex 24 at the center thereof and terminating at outer peripheral rim 25. In addition, in this embodiment of the present invention, concave shaped surface 26 incorporates a plurality of reflector vanes 30 formed on surface 26 and radially extending from apex 24. As detailed herein, vanes 30 provide a substantial enhancement to the dispersion of high frequency waves.

As depicted in FIGS. 1–5, the cross-sectional profile forming radically extending concave shaped surface 26 is not linear, but comprises a geometric form which defines an exponentially progressive curve. The form of the curve begins at the center or apex 24 of reflector 23 and proceeds in a radial fashion outwardly to rim 25. The curve is symmetrical both radially and annularly about the entire circumference of reflector 23. In addition, each reflector vane 30 is constructed with an exponential cross-section that is continuously variable over its entire length and with an axial profile that is also exponential. The feature of each vane being continuously variable over its profile is a function of, and an adjunct to, the ray analysis and wavelength propagation of the reflector surface profile. In analysis, the individual vane profiles emulate a specific section of the (host) reflector with the exception that they are physically positioned to cause acoustical reflections or secondary ray patterns at higher angles of incidence thereby supplementing the acoustical reflection properties of the reflector. The practical design of the vanes is in accordance with simple ray analysis based on the incidental and coincidental reflection properties of every wavelength of concern. The reflector is somewhat limited in its mathematically theoretical configuration to effectively allow both ideal lower frequency wave shaping and. at the same time, provide the ideal high frequency dispersion. Therefore, in order to avoid a significant compromise in reflector design, the reflector is primarily designed to control the reflections of the lower frequencies. Then, the vanes, as supplemental reflectors, can be designed to control the higher frequencies. When appropriate profile curves are designed for the reflector and the vanes, a synergistic harmony of full hemispherical reflections results.

In accordance with the present invention, the progression of radially extending concave shaped surface 26 of reflector 23 comprises a form/factor that is complementary to spherical enclosure 22. Since the diameter of the spherical enclosure 22 is fixed, the diameter thereof becomes the reference baseline for calculating the profile shape of surface 26 of reflector 23. Since the shape of surface 26 comprises a continuous exponentially progressive curve, the exponential form must become a variable in its progression in order to affect the desired result. This continuous exponential curve is best defined by the following formula:

$$De=(P_1I)^k, (P_2I)^k \ldots (P_nI)^k$$

| | |
|---|---|
| where: | De = Linear axial distance between reflector and sphere at any incremental position along the acoustical path. |
| and: | $P_1, P_2 \ldots P_n$ = Linear axial distance of any previous (numbered) De |
| and: | $^k$ = wavelength coefficient factor (in exponential form). Expressed as the expansion factor of the prime parameter $A_C/P_L$ |
| where: | $A_C$ = coupling; area of cross section |
| and: | $P_L$ = loading; pressure units per area unit |
| when: | I = a fixed linear increment. |

In addition, any linear distance between reflector 23 and spherical enclosure 22, at any mutual point along the radial dimension, is a numerical factor in the exponential progression. Accordingly, the specific exponential shape of surface 26 of reflector 23, along with reflecting ray patterns between the diaphragm of driver 21 and reflector 23, combine together to define the performance qualities of the ultimate objective, namely the acoustical spatial wave shaping which, in turn, describes a hemispherical polar coverage pattern within the system's power bandwidth at a point of summation of approximately eight times the reflector's diameter.

Furthermore, in this embodiment, vanes 30 are strategically placed about apex 24 of reflector 23 with the position and size of vanes 30 being determined by calculations based upon the wavelengths or frequencies of particular concern. The top or point end of each vane 30 is designed to represent the highest practical frequency of the system's power bandwidth, while the radiused or wide end of the vane is designed for the lowest or the cutoff frequency.

In accordance with the present invention, the cooperation of driver 21, spherical enclosure 22, and reflector 23 with vanes 30 on surface 26 establishes the final shape and coverage patterns of all of the frequencies produced by driver 21. By constructing surface 26 of reflector 23 and secondary reflector vanes 30 in the manner detailed above, an optimum, highly desirable, hemispherical sound wave pattern is achieved.

As discussed above, by forming the plurality of secondary reflector vanes 30 on surface 26 of reflector 23, high frequency dispersion is substantially enhanced and greater polar coverage linearity is achieved. As detailed above, the particular size, shape, number, and position of reflector vanes 30 are determined by the construction of surface 26 of reflector 23 and the polar coverage characteristics which result in conjunction with the acoustical energy source, namely driver 21.

In practice, secondary reflector vanes 30 function in exactly the same way as surface 26 of reflector 23. However, reflector vanes 30 are variable in profile at different angular positions. As a result, as is clearly depicted in FIGS. 4(*a*)–4(*d*), the performance achieved by reflector 23 incorporating vanes 30 is substantially enhanced.

By referring to FIG. 4(*a*), the acoustical ray pattern produced by surface 26 of reflector 23 is depicted. As shown therein, as the acoustic wave front impinges upon surface 26 of reflector 23, the waves or rays reflect off of surface 26 at different angles, with the reflected rays converging at a point away from reflector 23.

In order to eliminate or reduce the convergence of the reflected rays, it has been found that the incorporation of secondary reflector vanes 30 produce the desired enhanced result. In FIGS. 4(*b*)–4(*d*), the reflected ray pattern at different cross-sectional positions along vanes 30 are clearly shown. As is evident from a review of these Figures, vanes 30 produce a substantial enhancement to surface 26 of reflector 23. In this regard, the acoustical rays are reflected from vanes 30 on surface 26 of reflector 23 in an ever increasing parallel configuration, depending upon the radial position along the vanes 30 being considered. As a result, the convergence of the rays is substantially reduced or effectively eliminated.

In effect, vanes 30 represent segmented sections of surface 26 of reflector 23, with the acoustical near field being substantially unchanged. However, in the acoustical far field, passed the point of summation, the effect of incorporating vanes 30 on surface 26 is substantial. In this regard, the lobes produced by the incorporation of vanes 30 are summed and averaged, providing a smoothing condition due to the convex shape along the entire length of each vane 30.

As shown in FIG. 5, by incorporating vanes 30 on surface 26 of reflector 23, with vanes 30 being properly designed, correctly oriented, a substantially improved total or overall effect is achieved. In this regard, the high frequency band acoustical energy output is increased at the more obtuse or off-axis coverage angles of the hemispherical polar coverage pattern.

It will thus be seen that the objects set forth above, among those made apparent from the preceding description, are efficiently attained and, since certain changes may be made in the above article without departing from the scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Having-described my invention, what I claim is new and desired to secure by letters patent is:

1. A loudspeaker system constructed for producing hemispherically shaped sound patterns, said system comprising:

A. at least one loudspeaker driver for generating sound energy in response to the activation thereof, said driver comprising a circular shaped diaphragm mounted in juxtaposed, spaced, cooperating relationship with the portal zone of the housing;

B. a housing comprising a substantially spherical shape having an upwardly facing portal zone with the loudspeaker driver supportingly maintained therein, in cooperating relationship with the portal zone; and C. a reflector a. comprising a generally circular shaped, outer peripheral edge, b. mounted to said housing in juxtaposed, spaced, facing relationship with the portal zone thereof, c. incorporating a radially and annularly symmetrical, concave shaped, downwardly facing surface formed therein, said concave shaped surface of the reflector comprising a geometric form beginning at the center or apex of the reflector and proceeding radially outwardly to the circular shaped, outer peripheral edge to a terminating, centrally disposed apex, and comprising an exponentially progressive curve, said exponentially progressive curve comprising the following formula $$De=(P_1I)^k, (P_2I)^k \ldots (P_n)^k$$

| | |
|---|---|
| where: | De = Linear axial distance between reflector and sphere at any incremental position along the acoustical path. |
| and: | $P_1, P_2 \ldots P_n$ = Linear axial distance of any previous (numbered) De |
| and: | $^k$ = wavelength coefficient factor (in exponential form). Expressed as the expansion factor of the prime parameter $A_C/P_L$ |
| where: | $A_C$ = coupling; area of cross section |
| and: | $P_L$ = loading; pressure units per area unit |
| when: | I = a fixed linear increment, and |

d. a plurality of vanes formed on the concave shaped surface, peripherally surrounding the apex thereof in juxtaposed, spaced, cooperating relationship with the portal zone of the housing and the loudspeaker driver maintained therewith, thereby providing a substantially improved and enhanced hemispherically shaped acoustic energy coverage pattern, while also enhancing the wide angle dispersion of high frequency bandwidths.

2. The loudspeaker system defined in claim 1, wherein said reflector and said housing are further defined as being integrally interconnected to each other.

3. The loudspeaker system defined in claim 1, wherein said reflector and said housing are further defined as being rigidly mounted to each other.

4. The loudspeaker system defined in the claim 3, wherein the rigid interengagement of said reflector with said housing is achieved by employing one selected from the group consisting of rods, fins, bars, tubes, and channels members.

5. The loudspeaker system defined in claim 1, wherein the apex of the reflector is further defined as being positioned in acoustically intimate, coupled alignment with the center of the diaphragm of the loudspeaker driver.

6. The loudspeaker system defined in claim 5, wherein each of the plurality of vanes formed on said reflector are further defined as being spaced equidistant from each other.

7. The loudspeaker system defined in claim 6, wherein each of the plurality of vanes is further defined as comprising a cross-sectional area which is continuously variable over its entire length and is defined by an exponential formula.

8. The loudspeaker system defined in claim 7, wherein each of said vanes further comprises an axial profile that is also defined by an exponential.

9. The loudspeaker system defined in claim 8, wherein each of said vanes is further defined as comprising a tear-drop shape, with the top or point end thereof nearest to the apex of the reflector and the bottom or radiused end spaced away from the apex.

10. The loudspeaker system defined in claim 9, wherein the position and size of the point end of each vane is based upon the highest frequency output of the loudspeaker, while the position and shape of the radiused end of each vane is based upon the lowest or cutoff frequency of the loudspeaker.

* * * * *